United States Patent [19]

Specht et al.

[11] 4,317,708

[45] Mar. 2, 1982

[54] REMOTE-CONTROLLED JACK FOR INTERCELL CONNECTORS

[75] Inventors: Steven J. Specht, Mentor, Ohio; Morton S. Kircher, Clearwater, Fla.

[73] Assignee: Olin Corporation, New Haven, Conn.

[21] Appl. No.: 101,294

[22] Filed: Dec. 7, 1979

[51] Int. Cl.[3] ..... C25B 9/04; C25B 15/02

[52] U.S. Cl. ..... 204/228; 204/279; 204/253; 204/267

[58] Field of Search ..... 204/253–258, 204/267–270, 279, 228; 429/158, 160, 121; 339/75 M

[56] References Cited

U.S. PATENT DOCUMENTS

| | | | |
|---|---|---|---|
| 2,649,510 | 8/1953 | Michaelis | 204/228 X |
| 3,432,422 | 3/1969 | Currey | 204/258 |
| 3,494,850 | 2/1970 | Druylants | 204/228 |
| 3,783,122 | 1/1974 | Sato et al. | 204/279 |
| 3,930,978 | 1/1976 | Strewe et al. | 204/228 |
| 4,078,984 | 3/1978 | Strewe | 204/228 |
| 4,227,987 | 10/1980 | Kircher et al. | 204/253 X |
| 4,252,628 | 2/1981 | Boulton et al. | 204/258 X |

*Primary Examiner*—Delbert E. Gantz
*Assistant Examiner*—Donald R. Valentine
*Attorney, Agent, or Firm*—Ralph D'Alessandro; Donald F. Clements; Thomas P. O'Day

[57] ABSTRACT

A remote controlled intercell connector bar jack is disclosed. The jack can have a first contactor and a second contactor spaced apart by a piston and cylinder assembly. The assembly can be remotely expanded or contracted to move the contactors away from each other or towards each other, respectively. The first contactor contacts a movable intercell connector while the second contactor contacts a fixed object such as the wall of one of two adjacent cells connected by the intercell connector. The second contactor can be a plate adapted to rest against a wall of a cell to which the intercell connector is attached and the first contactor adapted to rest against the intercell connector so that the intercell connector is jacked away from the cell wall when the assembly is remotely expanded.

13 Claims, 4 Drawing Figures

REMOTE-CONTROLLED JACK FOR INTERCELL CONNECTORS

This invention relates to electro-chemical cells and more particularly to apparatus for use as an accessory to such cells. It has been a perpetual problem with electrolytic cells how to safely and efficiently disconnect and reconnect such cells from one another, especially when such cells are connected in an electrical series circuit in order to take one or more cells out of such circuit for maintenance or replacement. Disconnection and reconnection is preferably made as rapidly as possible in order that other cells in the circuit can be run as much of the time as possible. In fact, the normal practice in most electro-chemical plants is to attach one or more jumper switches around an electrolytic cell so that it can be electrically bypassed and then disconnected and reconnected without shutting down the other cells in the circuit. To allow such disconnection and reconnection, electrolytic cells are generally connected to one another by means of a removable intercell connector. In a copending application, Ser. No. 101,386, now U.S. Pat. No. 4,285,793 commonly assigned, a slideable intercell connector is disclosed which can be loosened and moved from a position in which it engages terminals of two cells to a position where it engages only one cell or vice versa. In order to move such an intercell connector, it is desirable to have some means for remotely controlling such movement so that the cells can be connected with a minimal amount of space therebetween and yet operator safety can be better assured.

The present invention solves this problem by providing a remote-controlled intercell connector bar jack. The jack can have a pair of contactors spaced apart by a piston and cylinder assembly. The assembly can be remotely expanded or contracted to move the contactors away from each other or toward each other, respectively. The first contactor can be adapted to rest against the intercell connector and the second contactor can be a plate adapted to rest against a wall of a cell to which the intercell connector is attached. When the assembly is expanded, the intercell connector is "jacked" away from the cell wall when the assembly is remotely expanded. Such movement of the intercell connector away from the cell wall can result in either disconnection of the intercell connector from the cell on which the cell wall is located or can result in movement of the intercell connector from a position engaging only a terminal of the cell on which the cell wall is located to a position engaging both that terminal and a terminal of another cell in an electrical series circuit of such cells. The structure of the jack preferably includes a pair of first contactors and a single second contactor but can include any other number of first or second contactors as required by the structure of the particular cell upon which it is to be used. Particularly preferred is a jack in which two first contactors are connected to the piston and cylinder assembly by a reverse C-shaped connecting means to enable the first contactors to be much closer to the second contactor than would otherwise be practical.

The invention will be better understood by reference to the attached drawings in which.

Figure 1:
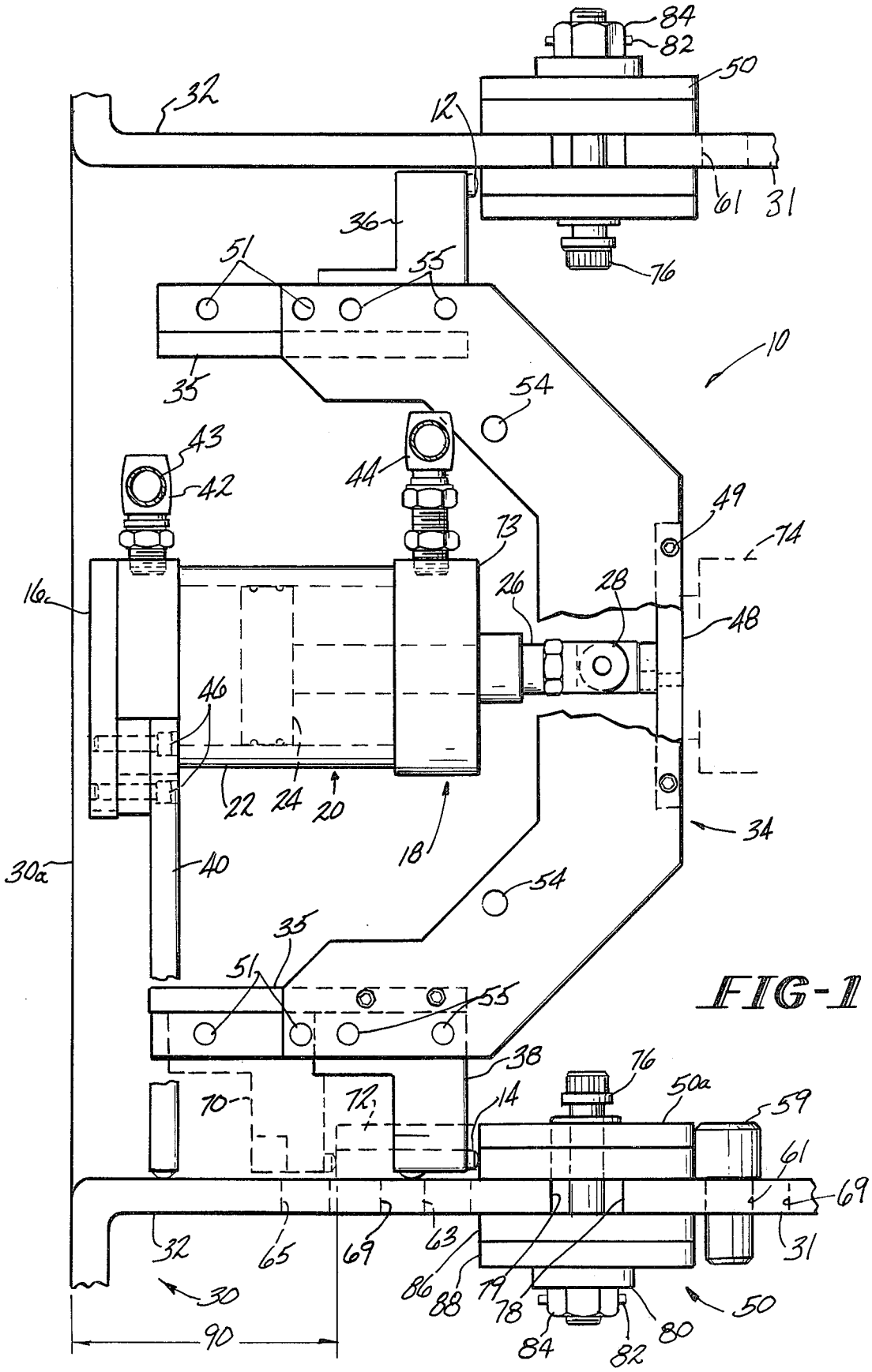
FIG. 1 is a front elevational view of the best currently envisioned mode of the jack of the invention in a position following its use to move an intercell connector from a disengaged position to the engaged position shown.
Figure 2:
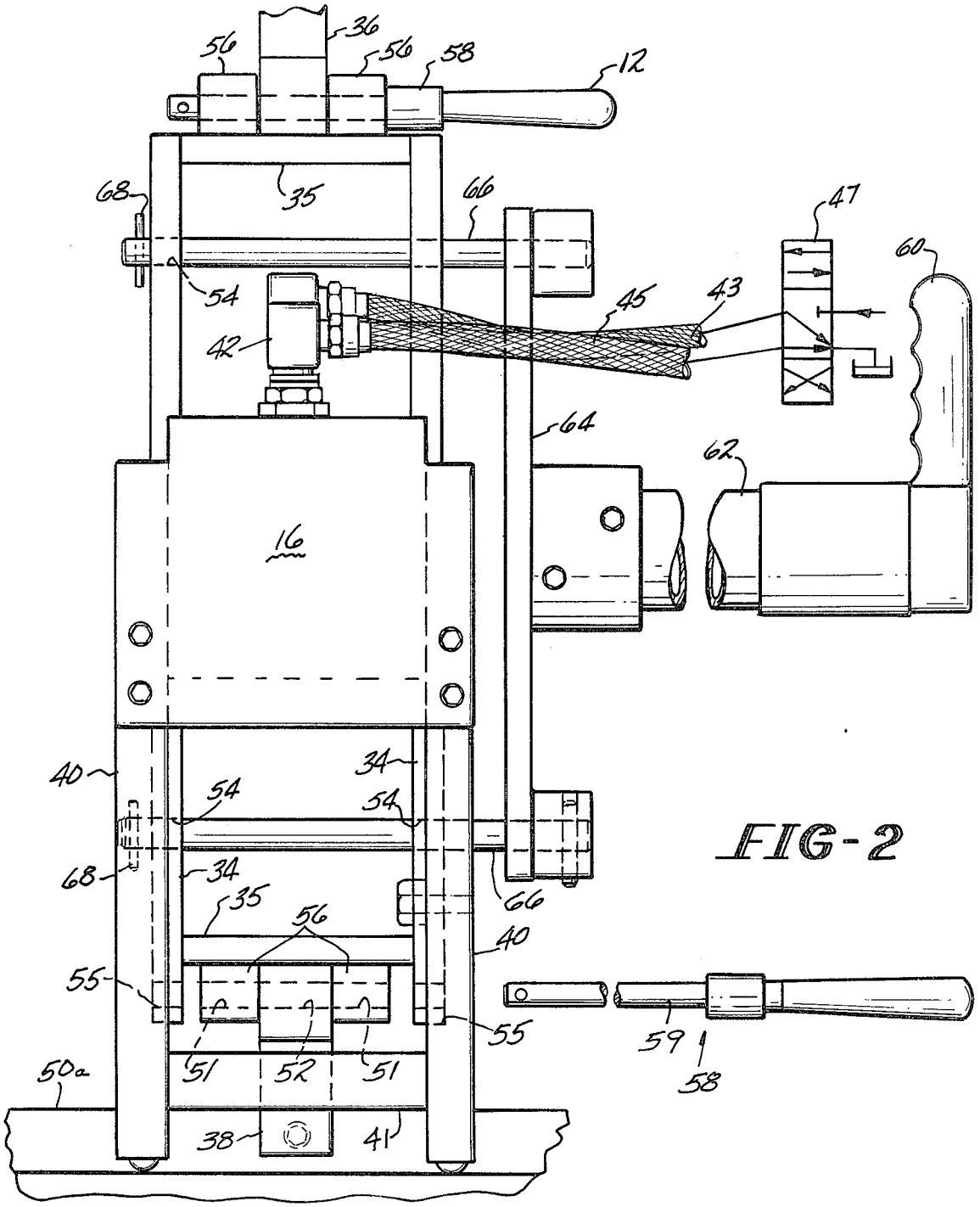
FIG. 2 is a side elevational view of the jack of FIG. 1, further including a handle and pole used before and after intercell positioning of the jack and a pin fork used for presetting the lateral intercell position of the jack.
Figure 4:
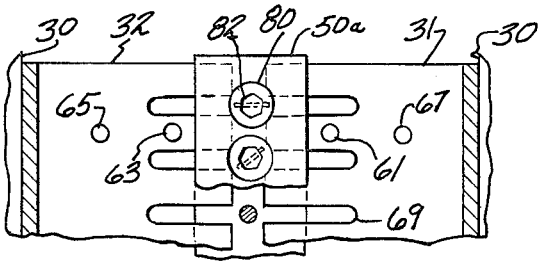
FIG. 4 is a top plan view of two adjacent terminals of two adjacent cells with a laterally slidable intercell connector in a position connecting the terminals.
Figure 3:
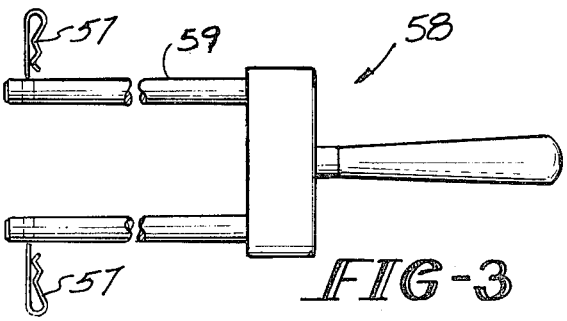
FIG. 3 is a top plan view of the pin fork of FIG. 2.

FIGS. 1, 2, and 3 show a preferred remote-controlled intercell connector bar jack designed to move an intercell connector bar from an engaged position to a disengaged position and vice versa. FIG. 4 shows a laterally movable intercell connector for connecting two adjacent cells 30 which is the subject of another commonly invented, commonly assigned application. The preferred intercell connector bar jack 10 of FIGS. 1–3 is designed to move the intercell connector of FIG. 4 laterally. Other intercell connectors could be moved in other manners by other intercell connector bar jacks. Intercell connector bar jack 10 which comprises two first contactor means 12 and 14, one second contactor means 16 and one pusher means 18. Pusher means 18 preferably comprises a hydraulic assembly 20, a pair of support legs 40, a pair of vertical cross members 34, a pair of contactor support arms 36, 38, and a clevis-type piston shaft connector 28. Hydraulic assembly 20 includes cylinder 22, piston 24, piston shaft 26, two hydraulic swivel connectors 42,44, two hydraulic flow lines 43 and 45 and a control valve 47. Hydraulic connectors 42 and 44 are connected, respectively, to two hydraulic fluid lines 43 and 45, so that hydraulic fluid can be supplied to and removed from opposite sides of piston 24 within cylinder 22. Hydraulic lines 43 and 45 are also connected to a three position, four-way, normally vented control valve 47 (see FIG. 2) of conventional design which controls the direction of flow through lines 43 and 45 in order to selectively expand and contract assembly 20.

Second contactor means 16 is a rigid rectangular plate which is attached to the back of cylinder 22 and which is adapted to rest against a wall 30*a* shown on the left of FIG. 1. In FIG. 1, contactor means 16 serves to prevent cylinder 22 from moving to the left when assembly 20 is expanded so that piston 24 moves to the right rather than cylinder 22 moving to the left. It will be apparent that assembly 20 could be readily reversed so that contactor means 16 is attached to the end of piston shaft 26 attached to piston 24 and cylinder 22 is attached to clevis connector 28, without altering the function of jack 10. However, in the embodiment shown, piston 24 is connected by piston shaft 26 to clevis connector 28. Thus, when assembly 20 expands piston shaft 26 forces clevis connector 28 to the right. Vertical cross members 34 and contactor support arms 36 and 38 are therefore also forced to the right since they are connected through a connector plate 48 to clevis connector 28. Contactors 12 and 14, arms 36 and 38, and members 34 are similarly moved to the right and contactors 12 and 14 shove intercell connector 50 to the right. The attachment of second contactor means 16 to the rear of cylinder 22 is accomplished by any suitable fastener means such as bolts 46 while the attachment of plate 48 to vertical cross members 34 is by means of any suitable fastener such as bolts 49. Upper and lower contactor support arms 36 and 38 are adjustably attached to a pair of adjusting blocks 56 (best seen in FIG. 2) which are in turn connected to horizontal cross plates 35. Horizontal cross plates 35 lie between and connect the top ends and bottom ends of vertical cross members 34. The lateral position (see FIG. 1) of arms 36 and 38 with respect to blocks 56 is determined by alignment of adjuster holes 51 in adjusting blocks 56 with adjusting holes 52 of arms 36 and 38. Blocks 56 are provided with two pairs of adjusting holes 51 so that arms 36 and 38 can be located in one of two positions depending on which pair of holes 51 are lying with holes 52. An adjusting block pin fork 58 serves to maintain alignment of holes 51 and 52. The pins 59 of pin fork 58 are inserted horizontally through holes 52 into holes 51 and then through another set of holes 52. The pins 57 of pin fork 58 may also be inserted through pin holes 55 in member 34. The pins 59 preferably each have a hole in which a quick release snap pin 57 can be inserted in order to maintain pins 59 in holes 51 and 52 following insertion. In order to better show the two positions of arms 36 and 38, the second or "retracted" position of arm 38 is shown in FIG. 1 by phantom lines 70. It will be understood that this retracted second position is utilized when intercell connector 50 is initially in its left most position shown by phantom lines 72. From such a position, expansion of assembly 20 results in movement of intercell connector 50 from the "disengaged" position shown by phantom line toward the "engaged" position shown in solid lines in FIG. 1. Therefore, it should be understood that the position of intercell connector 50 in FIG. 1 is a middle or "engaged" position, which is the position following such expansion of assembly 20. Assembly 20 continues to expand until the right hand side of intercell connector 50 comes to rest against a stop pin 59. If pin 59 is in hole 61 as shown in FIG. 1, connector 50 stops at the engaged position. If stop pin 59 was instead further to the right, assembly 20 continues to expand to a third or "expanded" position (not shown) with connector 50 disengaged or lying wholly on terminal 32, corresponding to the manner in which it lies on terminals 31 when at the position of phantom lines 72.

Vertical cross members 34 are also provided with two vertically aligned holes 54 which are adapted to receive pins 66 of a pole pin fork 64 attached to a pole 62. A handle 60 is attached to the end of pole 62 opposite pin fork 64. Handle 60 is oriented vertically and perpendicular to pole 62 in order to make use of handle 60 easier during the pushing and pulling operations involved in movement of jack 10 into and out of position between connector 50 and wall 30*a*, although it could instead by a simple bicycle type grip mounted on pole 62.

It will be appreciated that the movement of intercell connector 50 to either the right or left in FIG. 1 or 4 can result in disconnection of terminal 32 and 31 from one another. Stop pin holes 61, 63, 65 and 67 are used to receive stop pins 59 to determine how far intercell connector 50 can move in response to the expansion of jack 10. If it is desired to move connector 50 from a disengaged position, e.g. the position shown in phantom lines 72 of FIG. 1 to the engaged position shown in solid lines in FIG. 1 the stop pin 59 is located in hole 61. If it is then subsequently desired to move intercell connector 50 back to the position shown by phantom lines 72, pin 59 is moved to hole 65 and jack 10 is reversed so that second connector means 16 was on the right and clevis connector 28 on the left. Second contactor means 16 would then be adapted to rest against a wall of the following cell (not shown) and clevis connector 28 would be forced to the left in response to expansion of assembly 20. In order to better understand this alternate position, the piston end 73 of cylinder 22 then assumes the position which is shown in phantom by lines 74 of FIG. 1. When cylinder 22 is in this "reversed" position shown by pin 59 phantom 74, first connector means 12 and 14 would then be put in their middle or "normal" position in which they lie against the right hand side of intercell connectors 50 and expansion of assembly 20 would then result in intercell connector 50 being moved back to the position shown by phantom line 72, at which point pin 59 (now in hole 65) stops further leftward movement. With stop pin 59 located in holes 65, intercell connector 50 cannot move past stop pin 59 and will therefore be limited in its leftward movement to the position shown by phantom line 72.

When intercell connector 50 is in the position shown in FIG. 1 (solid lines) bolts 76 of intercell connector 50 are loosened from threaded sleeves 80 so that the upper portion 50*a* and lower portion 50*b* of intercell connector 50 will allow it to move about slightly thereby allowing intercell connector 50 to slide along terminals 31 and 32. A retainer pin 82 and retainer nut 84 prevent bolt 76 from moving completely upward out of threaded sleeve 80. Movement of bolt 76 out of sleeve 80 is not desired because the bottom plates 86 and 88 would then fall off and have to be retrieved and connector 50 would have to be reassembled. Terminals 31 and 32 can preferably have recesses 69 in order to allow the shaft of bolt 76 to move inwardly past the outer ends 78 and 79 of terminals 31 and 32.

FIG. 3 shows a top view of pin fork 58 so that the structure of pin fork 58 can be readily seen to be a handle and two pins. The pins 59 as above described are inserted through holes 51 and 52 in order to determine the position of arms 36 and 38 with respect to vertical cross members 34. Snap pins 57 are then inserted through pins 59 to lock fork 58 in position.

Although the invention has been shown and described in terms of the best mode currently envisioned, it will be understood that the pin structure can be varied within the scope of the invention. For example, vertical cross members 34 are shown to be C-shaped even though they could be many other configurations within the scope of the invention. The C-shaped structure as shown is preferred in order to maximize the length of cylinder 22, i.e. to maximize the piston stroke length attainable within a restricted space such as the space 90 between cell wall 30*a* and the leftmost position of the left side of the connector 50, i.e. the left side of connector 50 when in the position shown by phantom lines 72. The means of adjusting the position of arms 36 and 38 with respect to blocks 56 and cross members 34 could be any conventional means such as bolts, screws, cotter pins, straps, or clips.

Suitable for use as cylinder 20 is a 4" diameter, $3\frac{1}{4}$" stroke medium duty hydraulic cylinder such as a 500-pound-per-square-inch-rated, non-magnetic Model no. 66-B Miller hydraulic cylinder. Any other conventional hydraulic cylinder or pneumatic cylinder of equivalent size could be substituted. Suitable for use as hydraulic connectors 42 and 44 are Parker-Hannifin male or female swivel connectors Model no. S-2102-6-6 or Model no. S-2202-6-6. The various structure components of jack 10, such as vertical cross members 34, plates 16 and 48, plates 35, blocks 56, arms 36 and 38, pins 66, pin fork 64, pole 62, and pin fork 58 could all be made of aluminum so as to make jack 10 relatively light and easy to manipulate. These structure components could be made of lighter materials at greater expense or could be made of heavier materials at perhaps less expense, as desired. It is not necessary that the components other than assembly 20, be made of non-magnetic material since assembly 20 will, if non-magnetic, serve to provide sufficient resistance to prevent any significant electrical flow through jack 10 during operation. Also, it will be understood that jack 10 rests entirely upon and only in contact with either an anode or a cathode terminal, but not both. Therefore, there is essentially no potential difference through jack 10 and hence, very little, if any, current flow therethrough. This is especially true when, as is normally the case, terminals 31 and 32 are made of a highly conductive material such as copper.

FIG. 4 is a top plan view of the intercell connector bar 50 of FIGS. 1–2 having a top plate 50*a* and a bottom plate held together by a bolt 76 (see FIG. 1) threaded into a threaded sleeve 80 and held captive by a retainer pin 82. Plate 50*a* can be slid to the right or left into recesses 69 in the ends 78 and 79 of terminals 32 and 31 (see FIG. 1). Holes 61, 63, 65, and 67 (see FIGS. 1 and 4) are preferably provided to receive stop pins 59 (see FIG. 1) to limit lateral movement of connector 50.

With the above disclosure in mind, it will be understood that other modifications will become apparent to those of ordinary skill in the art of designing electrochemical cells and the following claims are to be accorded with the broad scope to which they are therefore entitled. However, before reviewing the following claims, some definitions should be first understood.

The work "jack" as used herein means a device which serves to exert an expansive force, generally in excess of that humanly possible without aid of a tool, against its opposite ends. A jack can exert this force, for example, by mechanical, electrical, hydraulic, pneumatic or even magnetic means. A conventional mechanical or hydraulic car jack and a typical pneumatic service station car lift are well-known examples of "jacks". "Remote-controlled" as used herein with reference to an intercell connector bar jack means controlled by operations performed at a location other than in the space between two electrolytic cells connected in electrical series along the overall current flow path between said cells, i.e. other than "intercell".

What is claimed is:

1. A remote-controlled intercell connector bar jack which comprises:

first contactor means for contacting an intercell connector;

second contactor means for contacting a cell wall of a cell;

pusher means, connecting said first and second contactor means for expanding to push said first contactor against said intercell connector and to move said first contactor means and said intercell connector means away from said second contactor means and said cell wall whereby said cell is disconnected from another cell.

2. The jack of claim 1 wherein:

said pusher means is a piston and cylinder assembly with said piston connected to one of said first and second contactor means and the cylinder connected to the other of said first and second contactor means.

3. The jack of claim 2 wherein:

said jack further comprises an adjustable connector means between said pusher means and one of said first and second contactor means for adjusting the distance between said first and second contactor means independently of said pusher means.

4. The jack of claim 3 wherein:

said jack further comprises a support means for supporting said jack on a cell associated with said intercell connector while allowing expansion of said pusher means.

5. The jack of claim 1 wherein:

said jack further comprises an adjustable connector means between said pusher means and one of said first and second contactor means for adjusting the distance between said first and second contactor means independently of said pusher means.

6. The jack of claim 1 wherein:

said jack further comprises a support means for supporting said jack on a cell associated with said intercell connector while allowing expansion of said pusher means.

7. The jack of claim 6 wherein:

said support means is adapted to support said jack on a terminal of said cell.

8. The jack of claim 7 wherein:

said support means comprises at least one first support leg attached to said first contactor means and at least one second support leg attached to said second contact means, each of said legs adapted to stand on an upper surface of said cell terminal.

9. The jack of claim 1 wherein:

said first contactor means further comprises at least two spaced contact arms means and a connecting member for simultaneously connecting both of said contact arms to said pusher, each of said contact arms being adapted to simultaneously contact a separate intercell connector, whereby at least two intercell connectors can be simultaneously moved so as to allow simultaneous connection and simultaneous disconnection of all terminals of a cell having at least two terminals.

10. The jack of claim 9 wherein:

said pusher means is a single piston and cylinder assembly.

11. The jack of claim 10 wherein:

said second contactor means comprises at least one plate positioned in axial alignment with said single piston and cylinder assembly and adapted to contact said cell wall at a point between said first contactor means.

12. The jack of claim 11 wherein:

said connecting means comprises a C-shaped member having a center and two ends;

said piston and cylinder assembly is attached to the center of said C-shaped connecting means and extends therefrom to form, together with said connecting means, an E-shaped overall structure;

said two contact arms are attached to the ends of said C-shaped connecting means and extend transversely to the axis of said piston and cylinder assembly; and said first contact means is attached to the opposite end of assembly from said C-shaped connecting means.

13. The jack of claim 12 wherein:

said jack further comprises a pushing pole, a handle attached to said pole, and a releasable attachment means for selectively connecting said pole to said jack in a position extending perpendicular to the axis of said piston and cylinder assembly, whereby said jack can be pushed or pulled in a direction perpendicular to the axis of said piston and cylinder assembly.

* * * * *